US011629727B2

(12) United States Patent
Cai

(10) Patent No.: US 11,629,727 B2
(45) Date of Patent: Apr. 18, 2023

(54) BLADELESS FAN WITH MULTIPLE AIR DUCTS

(71) Applicant: AIRMATE ELECTRICAL (JIU JIANG) CO., LTD, Jiangxi (CN)

(72) Inventor: Zhengfu Cai, Jiangxi (CN)

(73) Assignee: AIRMATE ELECTRICAL (JIU JIANG) CO., LTD, Jiujiang (CN)

( * ) Notice: Subject to any disclaimer, the term of this patent is extended or adjusted under 35 U.S.C. 154(b) by 5 days.

(21) Appl. No.: 17/521,888

(22) Filed: Nov. 9, 2021

(65) Prior Publication Data

US 2022/0145901 A1 May 12, 2022

(30) Foreign Application Priority Data

Nov. 10, 2020 (CN) ..... CN202011248167
Nov. 10, 2020 (CN) ..... CN202022588290

(51) Int. Cl.

| | |
|---|---|
| ***F04D 29/42*** | (2006.01) |
| ***F04D 25/06*** | (2006.01) |
| ***F04D 17/16*** | (2006.01) |
| ***F04D 29/28*** | (2006.01) |
| ***F04D 29/70*** | (2006.01) |
| ***F04F 5/16*** | (2006.01) |
| ***F04D 25/08*** | (2006.01) |
| *F04D 25/10* | (2006.01) |

(52) U.S. Cl.

CPC ..... *F04D 29/4246* (2013.01); *F04D 17/16* (2013.01); *F04D 25/06* (2013.01); *F04D 25/08* (2013.01); *F04D 29/288* (2013.01); *F04D 29/703* (2013.01); *F04F 5/16* (2013.01); *F04D 25/10* (2013.01)

(58) Field of Classification Search

CPC ..... F04D 25/08; F04D 29/4246; F04F 5/16; F04F 1/0014; F24F 7/007; F24F 13/20

See application file for complete search history.

(56) References Cited

U.S. PATENT DOCUMENTS 4,476,773 A * 10/1984 Fehr ..... F04D 29/462 415/206
10,753,667 B2 * 8/2020 Zhu ..... F25D 17/04
2019/0134548 A1 * 5/2019 Yoon ..... F24F 1/00

FOREIGN PATENT DOCUMENTS

CN 106979555 A * 7/2017 ..... F24F 1/0014

OTHER PUBLICATIONS

CN 106979555—Translation from Espacenet (Year: 2017).*

* cited by examiner

*Primary Examiner* — J. Todd Newton
*Assistant Examiner* — Behnoush Haghighian

(57) ABSTRACT

A bladeless fan with multiple air ducts is disclosed. The bladeless fan has a fan housing, a control system arranged in the fan housing, a blower system connected with the control system, an intermediate air duct communicating with the blower system and a rotation component connected with the control system. The intermediate air duct is provided with a side air duct at its both sides, the rotation component is connected with the side air duct to drive the side air duct to fold and unfold with the intermediate air duct as a center shaft. The side air duct is driven by the rotation component to fold and unfold with the intermediate air duct as a center shaft. The fold and unfold of the side air duct can achieve different effects, satisfy the user's requirement and improve the user experience.

6 Claims, 7 Drawing Sheets

BLADELESS FAN WITH MULTIPLE AIR DUCTS

CROSS REFERENCE TO RELATED APPLICATIONS

The present application claims the benefit of Chinese Patent Application Nos. 202011248167.1 and 202022588290.X filed on Nov. 10, 2020. All the above are hereby incorporated by reference their entirety.

TECHNICAL FIELD

The present disclosure relates generally to an electric fan field, and more particularly relates to a bladeless fan with multiple air ducts.

BACKGROUND

Electric fan is an electric appliance that drives the fan blades to rotate by a motor thus accelerating the air circulation. It is mainly used for cooling, relieving summer heat and circulating air. The electric fan is mainly composed of a drive motor, fan blades, a protective screen cover and a control device. With the continuous progress of society, human needs are constantly changing and a variety of categories of electric fans have also been derived. According to the use category, the traditional fan includes a ceiling fan, a table fan, a floor fan, a ventilation fan, an air conditioning fan, a tower fans and a bladeless fan. The bladeless fan is one of the newly emerging fan categories, which has changed the traditional image of the fans in people's impression by intuitively hiding the traditional fan blades inside the body, but providing the function which is no different from that of the traditional fan. Its appearance and function are more brief, beautiful and exquisite, which not only highlights the personalized pursuit, but also improves the grade virtually, thus indicating the development trend of the whole electric fan industry.

At present, the bladeless fan on the market has relatively simple function. It generally has just one or two air ducts, so has following disadvantages such as single air supply direction, small air supply area, small air supply volume and short air supply distance. Therefore, its air supply effect is far poor than that of the traditional fans, which capable of providing the user the experience of large air volume and large air supply area, and its user experience is not comfortable enough. Accordingly, the existing bladeless fan can not meet the user's requirement in the real-life. Therefore, it is necessary to design a bladeless fan with multiple air ducts capable of adjusting its air supply angle, providing a large volume and point-to-point air supply to overcome the above problems.

SUMMARY

The object of the present application is to provide a bladeless fan with multiple air ducts aiming at least one of defects and shortcomings discussed above.

According to an aspect, a bladeless fan with multiple air ducts is provided, which comprising a fan housing, a control system arranged in the fan housing, a blower system connected with the control system, an intermediate air duct communicating with the blower system and a rotation component connected with the control system; wherein the intermediate air duct is provided with a side air duct at its both sides, the rotation component is connected with the side air duct to drive the side air duct to fold and unfold with the intermediate air duct as a center shaft.

In an embodiment of the present application, the rotation component comprises a driving gear, a driven rack plate, a driven gear and a first driving part connected with the driving gear; wherein both outer sides of the driven rack plate are oppositely provided with a first rack engaging with the driven gear, respectively, while both inner sides of the driven rack plate are oppositely provided with a second rack engaging with the driving gear, respectively; wherein the second rack is parallel to the first rack, the side air duct is provided with a rotation bearing connected with the driven gear, such that when the first driving part drives the driving gear to rotate, the side air duct is brought to rotate through a linkage movement of the driven rack plate and the driven gear.

In an embodiment of the present application, the rotation component further comprises a connection plate for installing the driving gear and the first driving part; wherein the driving gear is located below the first driving part, the connection plate is arranged above the driven rack plate and the driven gear, while the driving gear and the first driving part are arranged at a center of the connection plate and located above the driven rack plate.

In an embodiment of the present application, the rotation component further comprises an angle control assembly, which comprises a Hall sensor board and a magnet arranged on the driven rack plate.

In an embodiment of the present application, the blower system comprises a filter screen assembly, a blower assembly and a second driving part, wherein the filter screen assembly is arranged at the fan housing.

In an embodiment of the present application, the filter screen assembly further comprises a filter screen shell, a primary filter screen and a composite filter screen successively arranged; wherein the composite filter screen comprises a HEPA filter screen, silver ions and activated carbon particles, wherein the filter screen shell is arranged at the fan housing while the filter screen assembly surrounds an outer side of the blower assembly.

In an embodiment of the present application, the blower assembly comprises a volute, a blower arranged in the volute and a second driving part connected with the blower, wherein the intermediate air duct and the side air duct are communicated with the volute.

The present disclosure has disclosed a bladeless fan with multiple air ducts, in which the side air duct is driven by the rotation component to fold and unfold with the intermediate air duct as a center shaft. In such a way, when the side air duct is fold and gathered together to the intermediate air duct, the air supply can be gathered together and the air supply distance can be increased. When the side air duct is unfolded with the intermediate air duct as the center shaft, the air supply area can be increased. Accordingly, the fold and unfold of the side air duct can achieve different effects, satisfy the user's requirement and improve the user experience.

DETAILED DESCRIPTION OF THE PREFERRED EMBODIMENT

To make the object, the technical solution, and the advantage of the present application more clearly, the present application is further described in detail below with reference to the accompanying embodiments. Obviously, the described embodiments are only part of the embodiments of the present application, not all of them. Based on the embodiments in the present application, all other embodiments obtained by one skilled in the art without creative work belong to the protection scope of the present application.

The present application is described in further detail below in combination with the accompanying drawings. These drawings are simplified schematic diagrams, which only illustrate the basic structure of the application in a schematic manner. The direction of the specific implementation of the application is based on the direction of FIG. 1.

Figure 1:
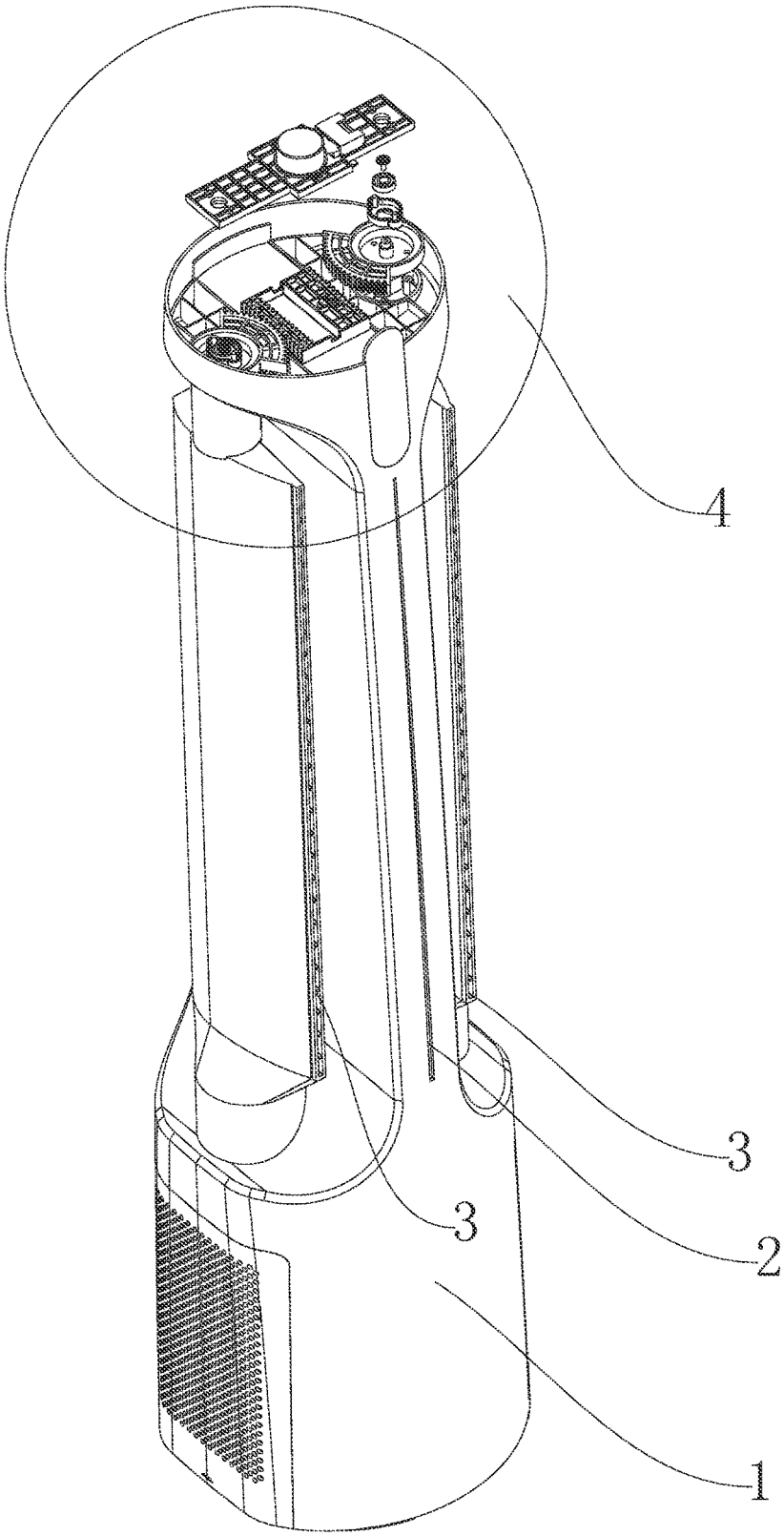
FIG. 1 is a partial exploded diagram of a bladeless fan with multiple air ducts according to an embodiment of the present application.
Figure 4:
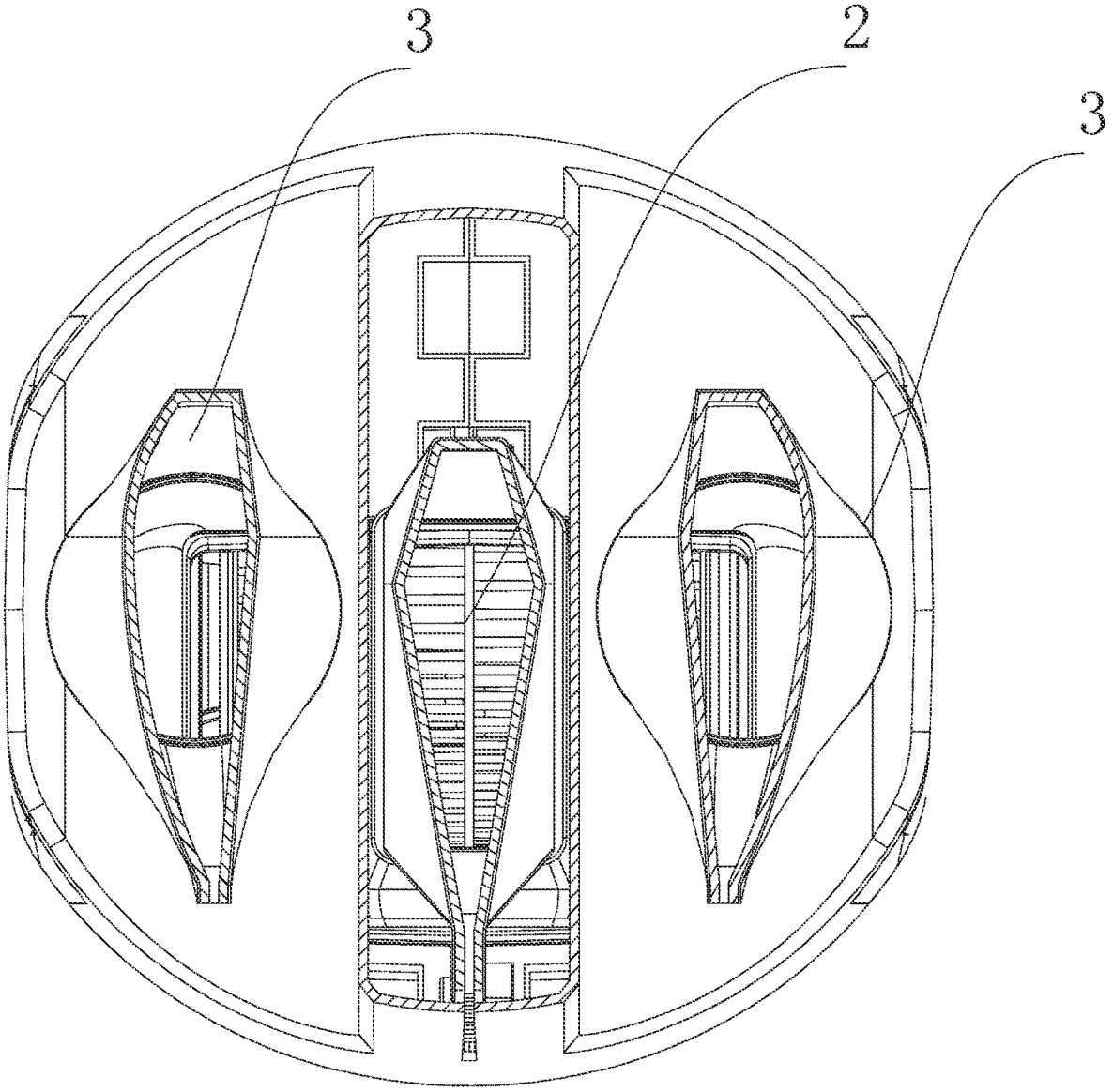
FIG. 4 is a transverse cross-sectional diagram of a bladeless fan with multiple air ducts according to an embodiment of the present application.
Figure 6:
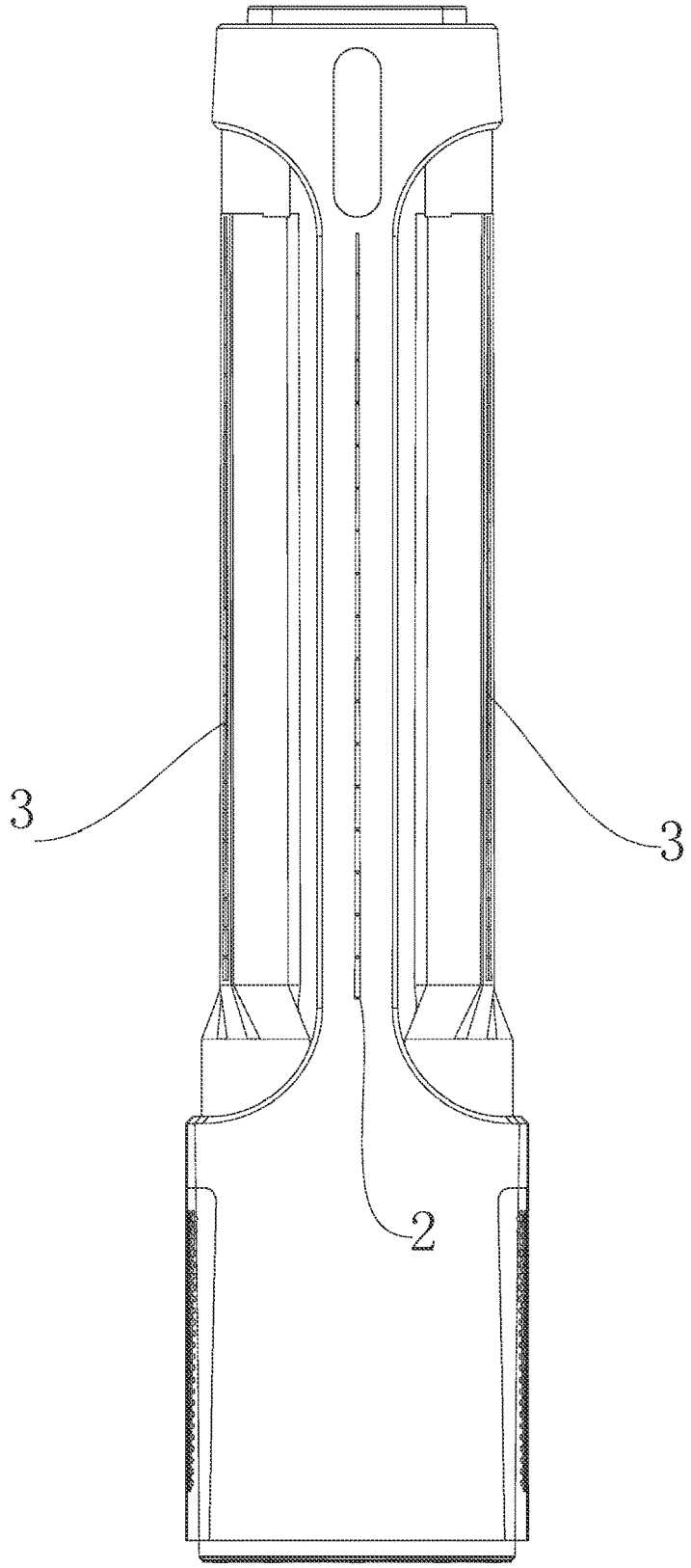
FIG. 6 is diagram showing an unfold state of a side air duct of a bladeless fan with multiple air ducts according to an embodiment of the present application.

As shown in FIG. 1, FIG. 4, FIG. 6 and FIG. 7, a bladeless fan with multiple air ducts is disclosed, which includes a fan housing 1, a control system 6 arranged in the fan housing 1, a blower system 5 connected with the control system 6, an intermediate air duct 2 communicating with the blower system 5 and a rotation component 4 connected with the control system 6. The intermediate air duct 2 is provided with a side air duct 3 at its both sides. The rotation component 4 is connected with the side air duct 3 to drive the side air duct 3 to fold and unfold with the intermediate air duct 2 as a center shaft. At least one side air duct 3 is arranged at each side of the intermediate air duct 2. Of course, two or more side air ducts 3 can be arranged at each side of the intermediate air duct 2. The specific number of the side air duct 3 are not limited herein. FIG. 1 and FIG. 4 have shown the initial state of the side air duct 3. FIG. 6 has shown the unfold state of the side air duct 3 with the intermediate air duct 2 as the center shaft, while FIG. 7 has shown the fold state of the side air duct 3 with the intermediate air duct 2 as the center shaft.

Figure 7:
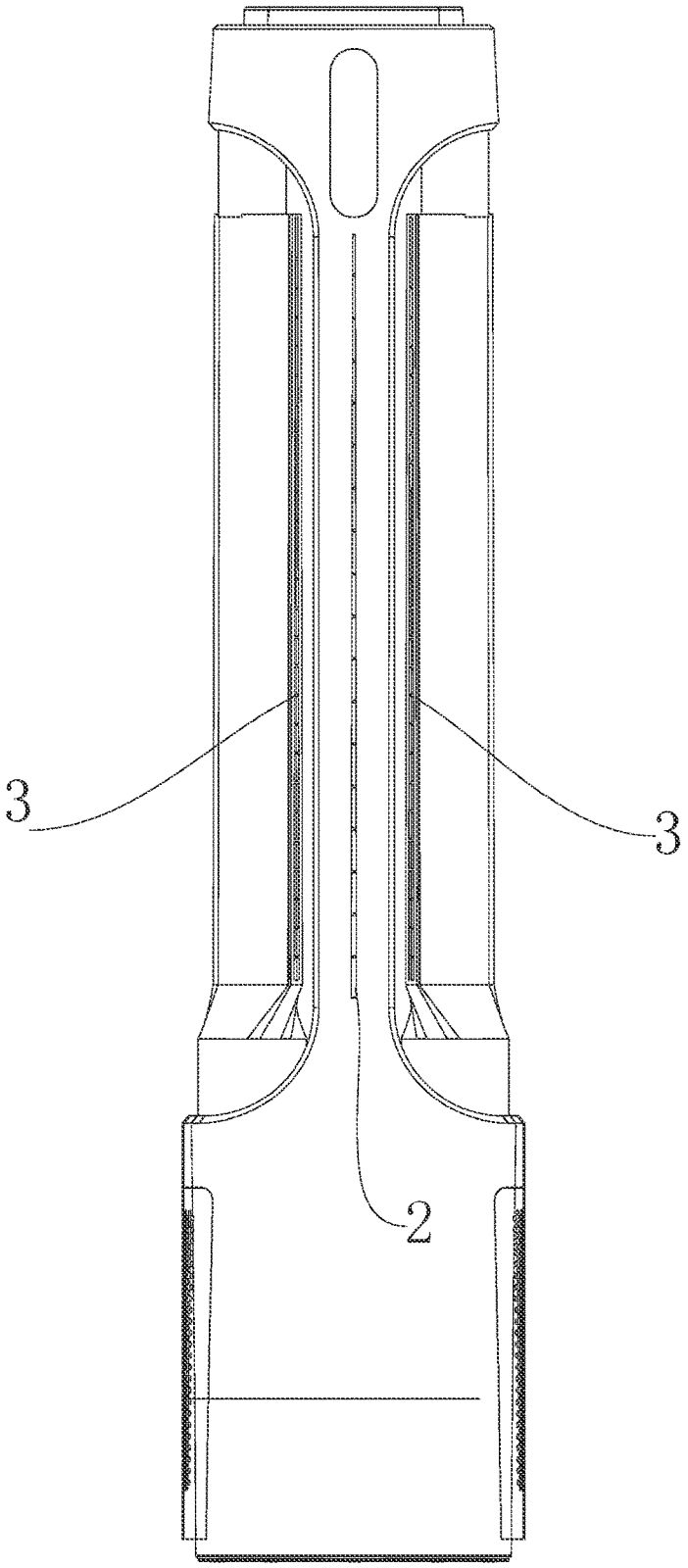
FIG. 7 is diagram showing a fold state of a side air duct of a bladeless fan with multiple air ducts according to an embodiment of the present application.

In the present disclosure, the side air duct 3 is driven by the rotation component 4 to fold and unfold with the intermediate air duct 2 as the center shaft. That is, the side air duct 3 can be expanded and retracted from the intermediate air duct 2. In such a way, when the side air duct 3 is fold and gathered together to the intermediate air duct 2 as shown in FIG. 7, the air supply can be gathered together and the air supply distance can be increased. When the side air duct 3 is unfold with the intermediate air duct 2 as the center shaft as shown in FIG. 6, the air supply area can be increased. Accordingly, the fold and unfold of the side air duct 3 can achieve different effects, satisfy the user's requirement and improve the user experience.

Figure 2:
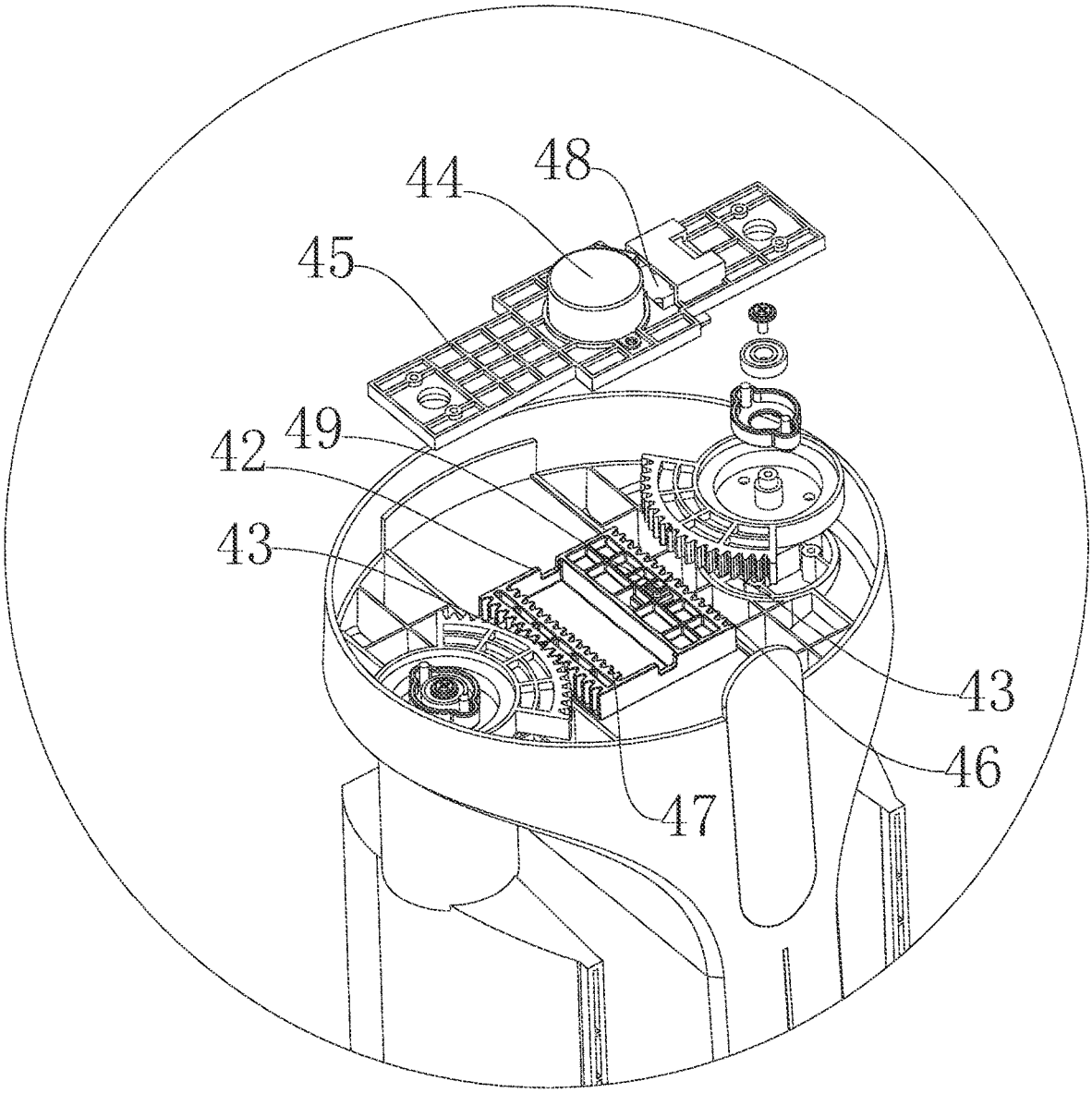
FIG. 2 is an enlarged diagram of the portion 4 shown in FIG. 1.
Figure 5:
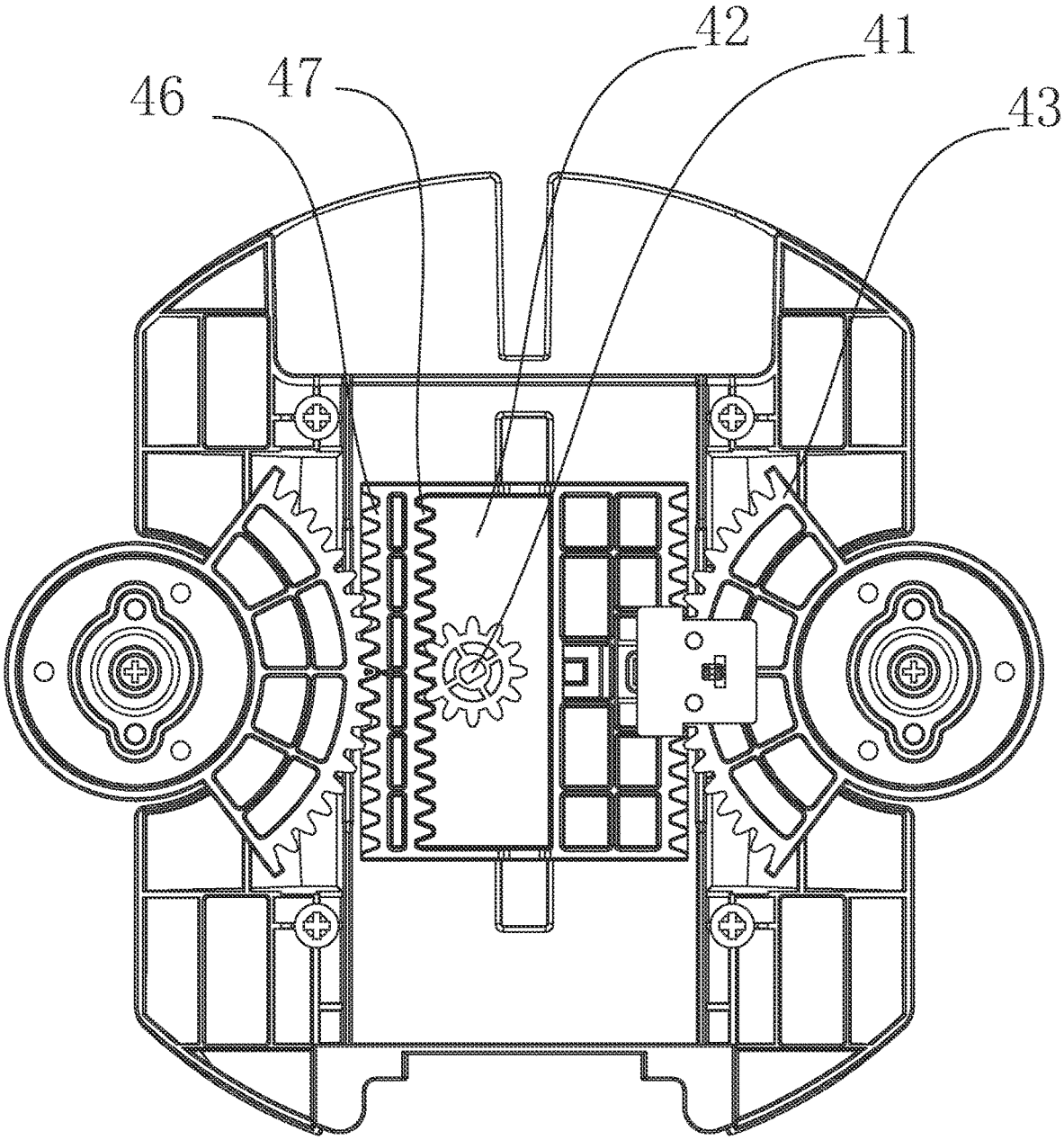
FIG. 5 is diagram showing a gear engagement of a rotation component of a bladeless fan with multiple air ducts according to an embodiment of the present application.

As shown in FIG. 2 and FIG. 5, the rotation component 4 comprises a driving gear 41, a driven rack plate 42, a driven gear 43 and a first driving part 44 connected with the driving gear 41. Both outer sides of the driven rack plate 42 are oppositely provided with a first rack 46 engaging with the driven gear 43, respectively, while both inner sides of the driven rack plate 42 are oppositely provided with a second rack 47 engaging with the driving gear 41, respectively. Wherein the second rack 47 is parallel to the first rack 46. The side air duct 3 is provided with a rotation bearing 7 connected with the driven gear 43, such that when the first driving part 44 drives the driving gear 41 to rotate, the side air duct 3 is brought to rotate through a linkage movement of the driven rack plate 42 and the driven gear 43. The first driving part 44 is connected with the control system 6 and drives the driving gear 41 located below the first driving part 44 to rotate. Then the driven gear 43 connected with the rotation bearing 7 of the side air duct 3 is brought to rotates through the reciprocation movement of the driven rack plate 42 engaging with the driving gear 41. Therefore, the side air ducts 3 at both sides of the intermediate air duct 2 can rotate clockwise and counterclockwise respectively, that is, to fold or unfold with the intermediate air duct 2 as the center shaft.

The rotation component 4 further comprises a connection plate 45 for installing the driving gear 41 and the first driving part 44. The driving gear 41 is located below the first driving part 44, the connection plate 45 is arranged above the driven rack plate 42 and the driven gear 43, while the driving gear 41 and the first driving part 44 are arranged at a center of the connection plate 45 and located above the driven rack plate 42. In this way, the connection plate 45 can raise the driving gear 41 and the first driving part 44 up so as not to hinder the reciprocation movement of the driven rack plate 42.

The rotation component 4 further comprises an angle control assembly, which comprises a Hall sensor board 48 and a magnet 49 arranged on the driven rack plate 42. The Hall sensor board 48 is connected with the first driving part 44 and realizes the signal sensing control by sensing the magnet 49 on the driven rack plate 42, thus controlling the swing speed and angle of the side air duct 3. When the magnet 49 coincides with the Hall sensor board 48, the side air duct 3 returns to the initial position.

Figure 3:
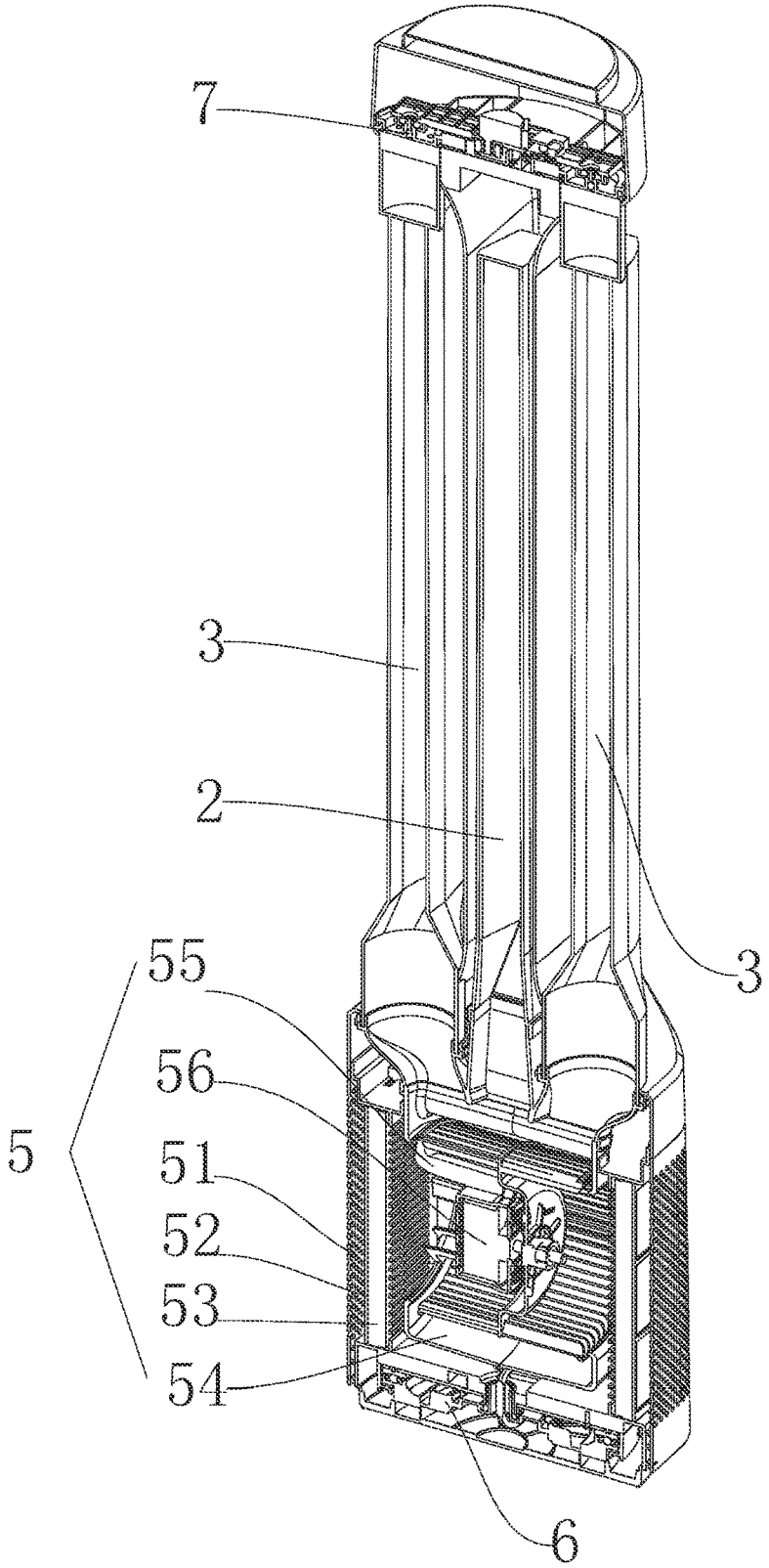
FIG. 3 is a vertical sectional diagram of a bladeless fan with multiple air ducts according to an embodiment of the present application.

As shown in FIG. 3, the blower system 5 comprises a filter screen assembly, a blower assembly and a second driving part 56, wherein the filter screen assembly is arranged at the fan housing 1. The second driving part 56 is connected with the control system 6, so that the dust particles in the air can be isolated through the multi-layer filtration, which can not only protect the components inside the fan, but also make the air blown out by the fan cleaner and fresher.

The filter screen assembly further comprises a filter screen shell 51, a primary filter screen 52 and a composite filter screen 53 successively arranged. The composite filter screen 53 comprises a HEPA filter screen, silver ions and activated carbon particles. The filter screen shell 51 is arranged at the fan housing 1 while the filter screen assembly surrounds an outer side of the blower assembly.

The blower assembly comprises a volute 54, a blower 55 arranged in the volute 54 and a second driving part 56 connected with the blower 55, wherein the intermediate air duct 2 and the side air duct 3 are communicated with the volute 54. The second driving part 56 drives the blower 55 to generate an air flow in the volute 54 to supply the air flow to the intermediate air duct 2 and the side air duct 3. The blower 55 may be a cross flow fan, a turbine fan, or an axial fan.

The bladeless fan with multiple air ducts can further includes a third driving part arranged at the bottom of the fan to drive the whole fan to rotate clockwise and counterclockwise, so as to increase the air supply area.

Therefore, the above description is only a better specific embodiment of the present disclosure, and the protection scope of the present disclosure is not limited to this. Any modification or replacement that can be easily thought of by one skilled in the art within the technical scope of the disclosure shall be included in the protection scope of the present disclosure, and the protection scope of the present disclosure shall be subject to the protection scope of the claims.

The invention claimed is:

1. A bladeless fan with multiple air ducts comprising a fan housing, a control system arranged in the fan housing, a blower system connected with the control system, an intermediate air duct communicating with the blower system and a rotation component connected with the control system; wherein the intermediate air duct is provided with a side air duct at its both sides, the rotation component is connected with the side air duct to drive the side air duct to expand and retract with the intermediate air duct as a center shaft;

wherein the rotation component comprises a driving gear, a driven rack plate, a driven gear and a first driving part connected with the driving gear; wherein both outer sides of the driven rack plate are oppositely provided with a first rack engaging with the driven gear, respectively, while both inner sides of the driven rack plate are oppositely provided with a second rack engaging with the driving gear, respectively; wherein the second rack is parallel to the first rack, the side air duct is provided with a rotation bearing connected with the driven gear, such that when the first driving part drives the driving gear to rotate, the driven gear connected with the rotation bearing of the side air duct is brought to rotates through a reciprocation movement of the driven rack plate engaging with the driving gear, such that the side air ducts at both sides of the intermediate air duct rotate clockwise and counterclockwise respectively, that is, to expand or retract with the intermediate air duct as the center shaft.

2. The bladeless fan with multiple air ducts according to claim 1, wherein the rotation component further comprises a connection plate for installing the driving gear and the first driving part; wherein the driving gear is located below the first driving part, the connection plate is arranged above the driven rack plate and the driven gear, while the driving gear and the first driving part are arranged at a center of the connection plate and located above the driven rack plate.

3. The bladeless fan with multiple air ducts according to claim 2, wherein the rotation component further comprises an angle control assembly, which comprises a Hall sensor board and a magnet arranged on the driven rack plate.

4. The bladeless fan with multiple air ducts according to claim 3, wherein the blower system comprises a filter screen assembly, a blower assembly and a second driving part, wherein the filter screen assembly is arranged at the fan housing.

5. The bladeless fan with multiple air ducts according to claim 4, wherein the filter screen assembly further comprises a filter screen shell, a primary filter screen and a composite filter screen successively arranged; wherein the composite filter screen comprises a HEPA filter screen, silver ions and activated carbon particles, wherein the filter screen shell is arranged at the fan housing while the filter screen assembly surrounds an outer side of the blower assembly.

6. The bladeless fan with multiple air ducts according to claim 5, wherein the blower assembly comprises a volute, a blower arranged in the volute and a second driving part connected with the blower, wherein the intermediate air duct and the side air duct are communicated with the volute.

* * * * *